US008925360B2

(12) United States Patent
Agbay

(10) Patent No.: US 8,925,360 B2
(45) Date of Patent: Jan. 6, 2015

(54) ROTATING DISK LOCK MECHANISM

(75) Inventor: Anthony John Agbay, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 366 days.

(21) Appl. No.: 12/888,116

(22) Filed: Sep. 22, 2010

(65) Prior Publication Data

US 2012/0067091 A1 Mar. 22, 2012

(51) Int. Cl.

| | |
|---|---|
| ***E05B 29/00*** | (2006.01) |
| ***E05B 67/36*** | (2006.01) |
| ***E05B 21/06*** | (2006.01) |
| ***E05B 35/10*** | (2006.01) |

(52) U.S. Cl.

CPC ..... *E05B 67/365* (2013.01); *E05B 21/066* (2013.01); *E05B 35/10* (2013.01)

USPC ..... 70/366; 70/365; 70/34; 70/337; 70/338; 70/340; 70/376

(58) Field of Classification Search

CPC ... E05B 21/066; E05B 29/0033; E05B 29/00; E05B 29/0013; E05B 47/0012; E05B 15/14; E05B 27/00; E05B 27/0032

USPC ..... 70/409, 365, 366, 34, 386, DIG. 42, 70/337, 338, 339, 340, 341, 342, 343, 376, 70/377, 402, 403, 405, 406, 407

See application file for complete search history.

(56) References Cited

U.S. PATENT DOCUMENTS

| | | | | | |
|---|---|---|---|---|---|
| 2,703,975 | A | * | 3/1955 | Ryndzonak | 70/38 A |
| 3,695,073 | A | * | 10/1972 | Prescott | 70/366 |
| 4,062,211 | A | * | 12/1977 | Miller et al. | 70/366 |
| 4,232,539 | A | * | 11/1980 | Lo | 70/492 |
| 4,370,875 | A | * | 2/1983 | Piiroinen | 70/422 |
| 4,407,147 | A | * | 10/1983 | Larson | 70/365 |
| 4,512,166 | A | * | 4/1985 | Dunphy et al. | 70/366 |
| 4,667,493 | A | * | 5/1987 | Takahashi | 70/366 |
| 4,742,703 | A | * | 5/1988 | DeWalch et al. | 70/366 |
| 5,086,631 | A | * | 2/1992 | Agbay | 70/366 |
| 5,490,405 | A | * | 2/1996 | Ramo et al. | 70/366 |
| 2006/0016230 | A1 | * | 1/2006 | Loughlin et al. | 70/366 |

* cited by examiner

*Primary Examiner* — Suzanne Barrett
*Assistant Examiner* — Duoni Pan
(74) *Attorney, Agent, or Firm* — McCormick, Paulding & Huber LLP

(57) ABSTRACT

A rotating disk lock mechanism that includes a lock housing containing a plurality of rotatable disks. Each disk having a central aperture and being positioned in a stack such that the central apertures form a keyway. At least one of the disks includes a reduced central aperture with a diameter that is substantially less than a diameter of at least another one of the central apertures. The combination of the lock mechanism is determined in part by the number of disks with reduced central apertures and their placement in the stack.

20 Claims, 18 Drawing Sheets

| DISK POSITION | | | | | | LEVEL | KEY CUTS |
|---|---|---|---|---|---|---|---|
| A | B | C | D | E | F | | |
|   | | | | | | 1 | 1 5 1 5 3 1 |
|   | | | | | | 2A | 1 5 5 5 3 1 |
|   | | | | | | 2B | 1 5 1 5 7 1 |
|   | | | | | | 3 | 1 5 5 5 7 1 |

ROTATING DISK LOCK MECHANISM

FIELD OF THE INVENTION

The present invention relates generally to a rotating disk lock mechanism and more particularly to a rotating disk lock mechanism that provides an enhanced number of potential combinations through the use of rotating disks and keys that include mating surfaces having a reduced size.

BACKGROUND OF THE INVENTION

Utility boxes, such as electric meter boxes, are typically secured to prevent unauthorized access to the meter. Many of such boxes are secured through the use of split ring that is placed directly around the meter and locked through the use of a barrel lock.

A preferred type of barrel lock for use with the above-described utility boxes is known as a rotating disk barrel lock. These locks include multiple rotating disks that, when rotated into the proper position via a key, will open the lock. An example of such a rotating disk barrel lock is described in U.S. Pat. No. 5,086,631, which is hereby incorporated by reference in its entirety.

Conventional rotating disk barrel locks typically contain a stack of six rotating disks that determine the combination of the lock. In particular, the placement of master disks, each having more than one operational position, within the stack of disks determines the particular combination of the lock and also the number of potential combinations and combination levels for such locks.

The universe of potential combinations is limited, however, in that conventional barrel locks can only accommodate six rotating combination disks. This restricted capacity is the result of industry standards that limit the length of the portion of the barrel lock in which the disks are housed. Indeed, if the lock is not dimensioned in accordance with these standards, it will be incompatible with other standardized lock components, such as lock caps and pad lock seals.

As will be appreciated, users of such locks, typically utility companies and the like, desire their own exclusive combination, or set of combinations, so that a key from one utility cannot open another's lock. Accordingly, a large number of potential combinations is desirable to ensure exclusivity.

In view of the above, it is a general object of the present invention to provide a rotating disk lock mechanism that provides an enhanced number of potential combinations, and combination levels, without increasing the number of rotating disks or the dimensions of the lock. It is also a general object of the present invention to provide a rotating disk lock mechanism in which the combination is not determined exclusively by the number and placement of master disks.

SUMMARY OF THE INVENTION

It is an object of the present invention to provide a rotating disk lock mechanism.

It is an additional object of the present invention to provide a rotating disk lock mechanism that provides an enhanced number of potential combinations.

It is an additional object of the present invention to provide a rotating disk lock mechanism that provides an enhanced number of potential combinations without increasing the number of rotating disks or the dimensions of the lock.

It is an additional object of the present invention to provide a rotating disk lock mechanism that provides an enhanced number of potential combinations through the use of rotating disks and keys that include mating surfaces of a reduced size.

It is an additional object of the present invention to provide a rotating disk lock mechanism that provides an enhanced number of potential combinations through the use of rotating disks and keys that include mating surfaces of a reduced size.

It is an additional object of the present invention to provide a rotating disk lock mechanism in which the combination is not determined exclusively by the number and placement of master disks.

An embodiment of the present invention is a rotating disk lock mechanism that includes a lock housing containing a plurality of rotatable disks. Each disk having a central aperture and being positioned in a stack such that the central apertures form a keyway. At least one of the disks includes a reduced central aperture with a diameter that is substantially less than a diameter of at least another one of the central apertures. The combination of the lock mechanism is determined in part by the number of disks with reduced central apertures and their placement in the stack.

Another embodiment of the present invention is a lock system that includes a rotating disk lock mechanism having a housing that includes a plurality of rotatable disks positioned in a stack within the housing. Each of the disks having a central aperture that, when positioned in the stack, form a keyway, at least one of the central apertures having a reduced diameter that is substantially less than a diameter of at least another one of the central apertures. The embodiment further includes a key having a plurality of key cam sections that engage and rotate the plurality of rotatable disks to lock or unlock the lock mechanism. At least one of the key cam sections has a reduced profile that engages the reduced diameter central aperture and rotates the disk having the reduced diameter central aperture.

Yet another embodiment of the present invention is a method of creating lock combinations in a rotating disk barrel lock that includes a plurality of rotatable combination disks, each of the disks having a central aperture with cam surfaces. The method includes selecting a plurality of rotatable combination disks, each of the combination disks including a central aperture having a first diameter and then selecting at least one rotatable combination disk including a central aperture having a second diameter that it substantially less than the first diameter.

DETAILED DESCRIPTION OF THE INVENTION

Figure 1A:
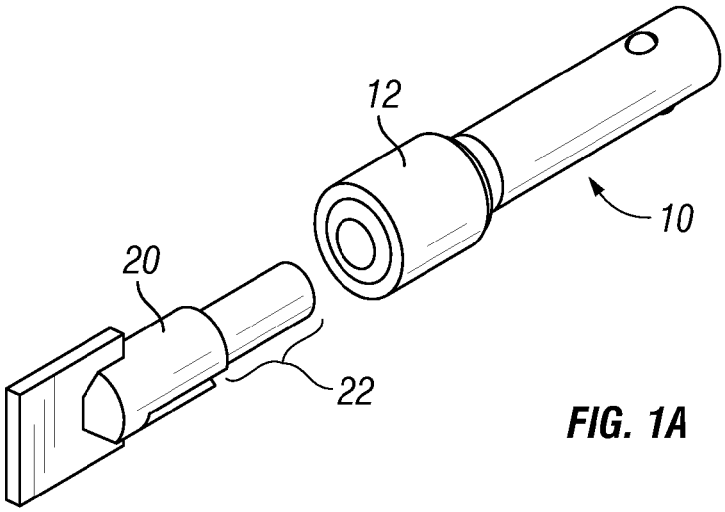
FIGS. 1A and 1B are a perspective view and a cutaway side view of a known rotating disk barrel lock.
Figure 1B:
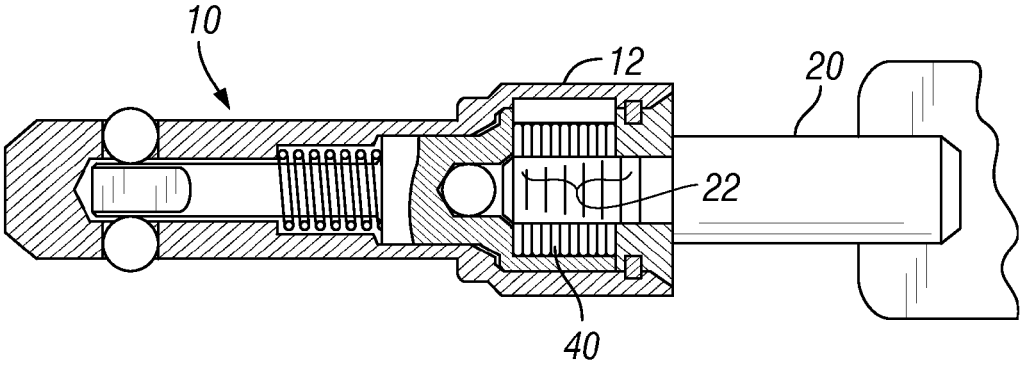

FIGS. 1A-3C depict a known rotating disk barrel lock 10 and known operating key 20. The barrel lock 10 includes a head portion 12 which contains a series of rotatable disks 40 that are arranged in a stacked relationship. Each rotatable disk 40 is spaced apart from adjacent disks by a spacer 30.

Figure 3A:
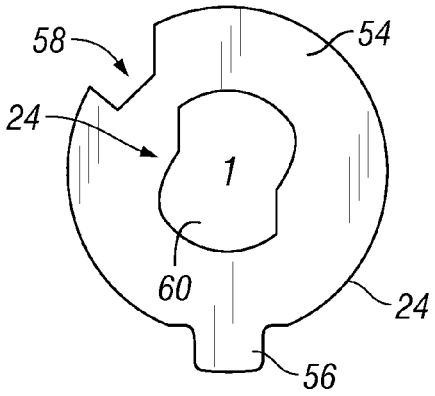
FIGS. 3A-3C enlarged views of combination disks of the barrel lock of FIG. 1 illustrating a rotating zero and combination disks.
Figure 3B:
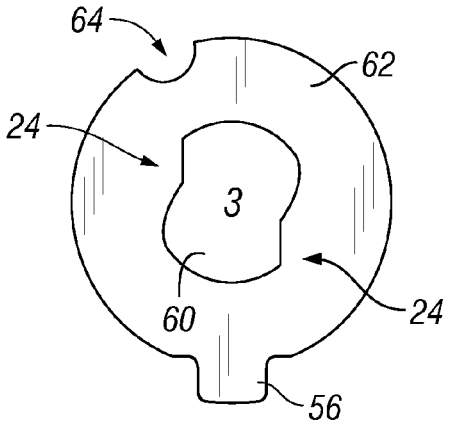
Figure 3C:
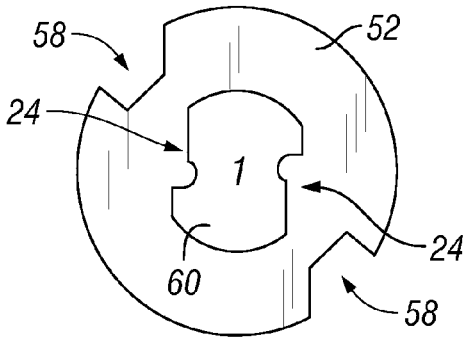

The key 20 include a series of longitudinally spaced "key cuts" referred to herein as cam surface sections 22. The number of cam surface sections 22 corresponds to the number of disks 40 in the lock and each cam surface section engages a separate disk. In particular, each cam surface section 22 engages spiral disk cam surfaces 24 located in a central aperture 60 of each disk thereby rotating the disks to lock or unlock the lock 10 (FIGS. 3A-3C).

The operation of the lock mechanism is described more fully in U.S. Pat. No. 5,086,631 and U.S. Patent Application Publication No. 2008/0105013, which are both incorporated by reference herein.

Figure 2:
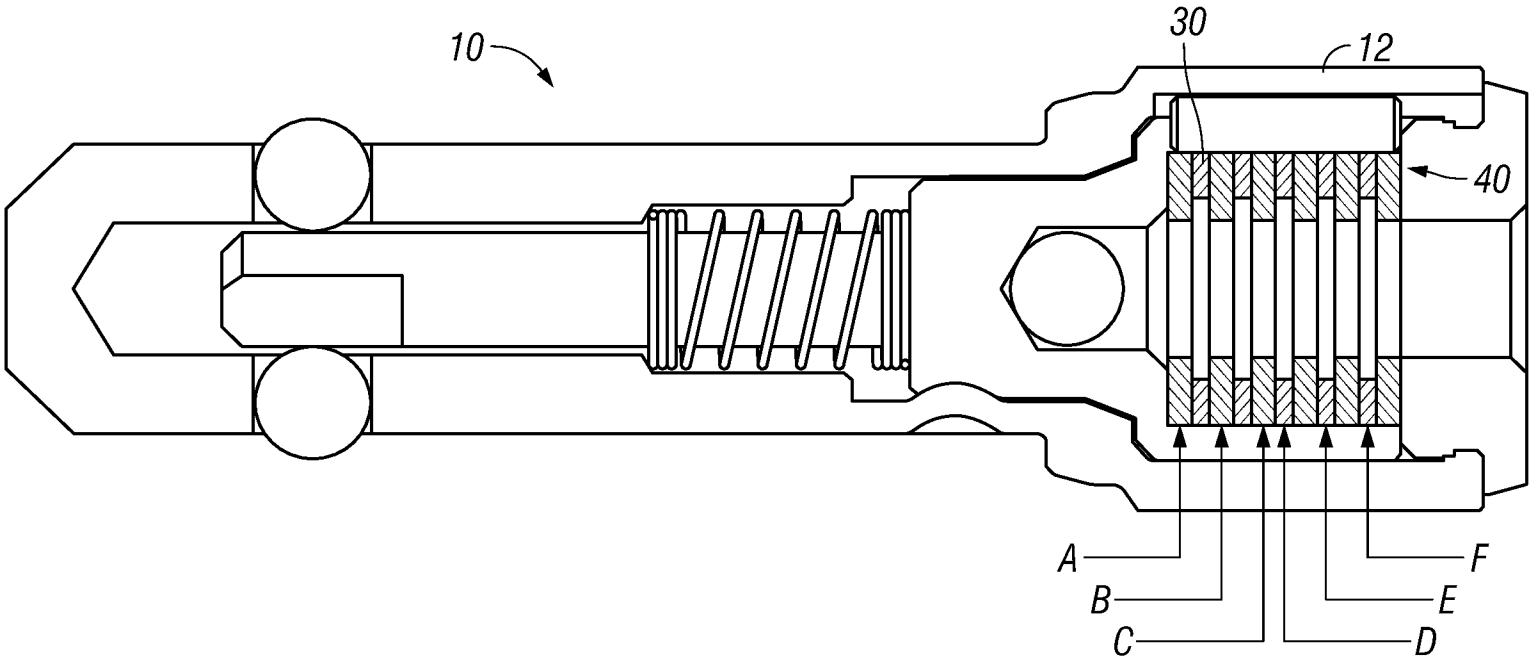
FIG. 2 is an enlarged cutaway side view of the barrel lock of FIG. 1.

Referring now to FIG. 2, the disks 40 are in a stacked relationship within the head portion 12 of the barrel lock 10. In particular, the disks are in set positions in a stack, which have been labeled in the figure. As shown, a disk is in a first position A, a second position B, a third position C, a fourth position D, a fifth position E and a sixth position F. The first position disk A is at the opposite end of the stack that initially receives the key and the sixth position disk F is at the end that first receives the key.

As stated, the head portion of lock has a length that is limited by industry standards. As will be appreciated, the length of the head portion dictates the number of disks that can fit within the lock. Known barrel locks typically contain five stacked combination disks that are spaced apart by washers and a sixth rotating disk in the sixth position F. The number of potential combinations is limited by the number of disks that can fit within the head portion.

Turning now to FIGS. 3A-4B, the stack of disks includes three basic types of disks. These include a rotating disk 52 or "zero" located in the sixth position F in the stack. The remaining five disks in positions A-E are all combination disks such as disk 62. The combination disk in the first position A, is referred to as the "lifting" disk 54 or lifting zero (FIG. 3A).

As shown, all of the disks include at least one combination notch 58, 64, 68. When these notches 58, 64, 68 are aligned from disk to disk they form a channel into which a locking bar drops allowing the lock to be rotated and unlocked. When the disks are scrambled, there is no formed channel or keyway as the notches are misaligned, and the lock is secured in a locked position. The combination disks 58, 62, 68 also include a radially protruding tab, 56, which limits rotation of the disks.

The combination notches 58, 62, 68 are in set positions on the combination disks. In particular, notch 58, shown on the lifting disk 54, is said to be in the "1" position (FIG. 3A). As depicted in FIG. 3B, combination notch 64 is in the "3" position. The other two commonly used positions for combination notches are the "5" and "7" positions which are designated by referenced numbers 66 and 68, respectively, and are shown in FIGS. 4A and 4B.

Figure 4A:
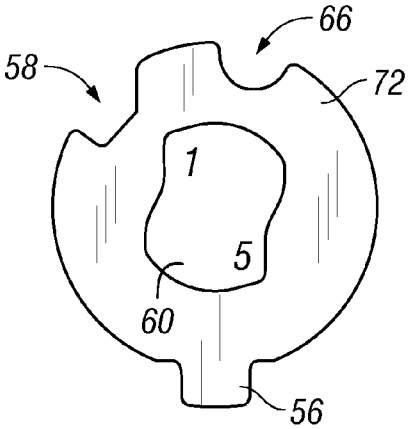
FIGS. 4A and 4B are enlarged views of master combination disks for use with the barrel lock of FIG. 1.
Figure 4B:
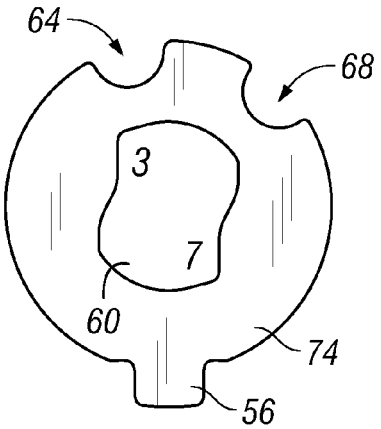

The combination disks 72, 74 shown in FIGS. 4A and 4B each have two combination notches. These disks are referred to as "master disks" as they can be opened by keys that have a cam surface section capable of rotating the disk to either of the combination notch positions. That is, a master disk 72 having 1, 5 notch positions may be rotated to an unlocked position by either a key with either a 1 cam surface section or a 5 cam surface section.

Figure 5:
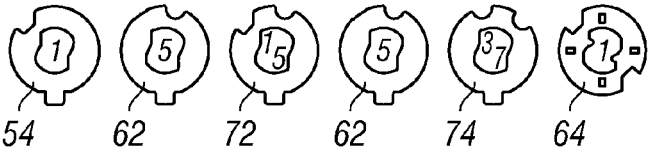
FIG. 5 is a diagram depicting a configuration of disks and corresponding key cuts for combination Levels 1-3 of the barrel lock of FIG. 1.
Figure 5:
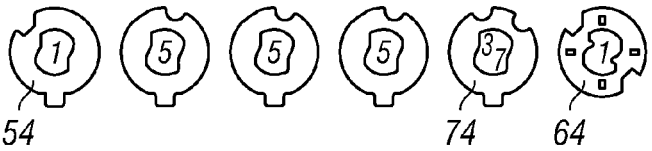
Figure 5:
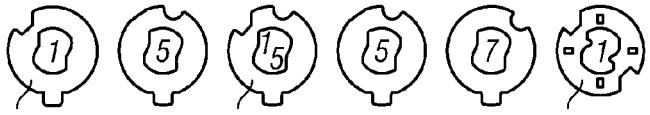
Figure 5:
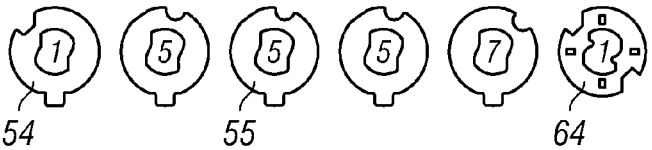

Turning now to FIG. 5, the placement of the two position master disks is used to create various lock combinations. For example, the Level 1 disk combination has two master disks 72 and 74 at the third and fifth disk positions, C and E, respectively. Master disk 72 is a 1, 5 combination disk and master disk 74 is a 3, 7 combination disk.

The corresponding Level 1 key has key cuts that correspond to the disk combinations. That is, each key cut corresponds to a specific disk notch position. In the case of master disks that have two combination notch positions, the key cuts correspond to one of the two notch positions. In the depicted example, the Level I key has cuts 1 and 3 corresponding to master disks 72, 74, which have 1, 5 and 3, 7 notch positions respectively.

The Level 2A and 2B combinations each have a single master disk 74, 72 at the fifth position E and the third position C. The Level 3 combination has no master disks at all.

Figure 6:
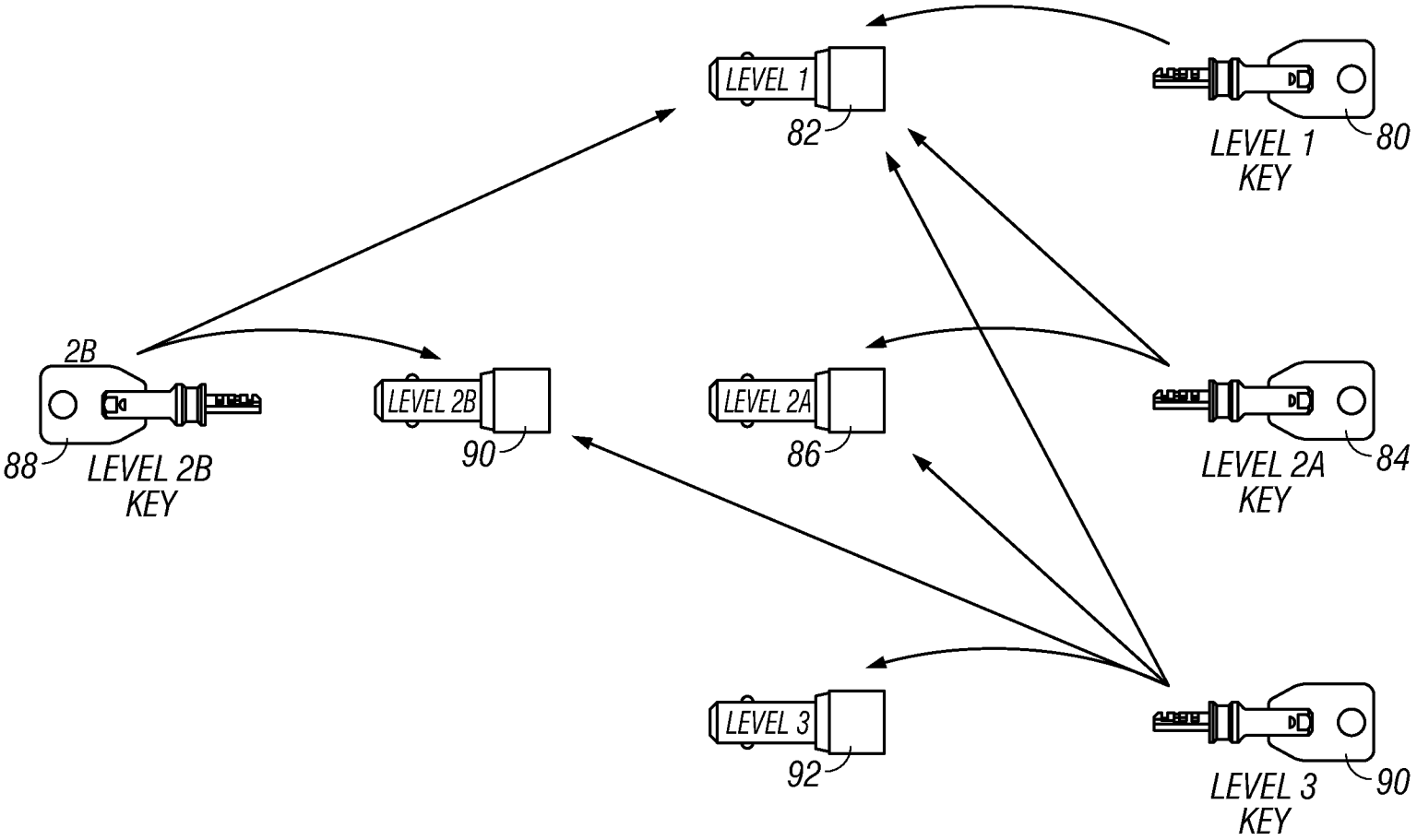
FIG. 6 is a chart graphically illustrating the inter-operability of keys for combinations Levels 1-3 of FIG. 5.

Turning now to FIG. 6, the practical result of the above is that higher level keys, e.g., Level 3 and 2 keys, can unlock lower combination level locks. For example, a Level 3 key can unlock locks employing Level 1, 2A, 2B and 3 disk combinations.

A Level 1 key cannot, however, unlock a barrel lock having a Level 3 disk combination as, for example, the key has a 1 cut that corresponds to disk 55 that has a combination notch at the 5 position. As will be appreciated, a 1 cut cannot rotate a 5 position disk into an unlocked state.

As stated, the number of potential combinations is limited by the number of disks that can fit within the head portion. As described in greater detail herein, the present invention allows for many additional combination levels and sub-levels by reducing the diameter of the central aperture 60 of the disks and reducing the size of the key cut corresponding to the reduced aperture disk.

Figure 7B:
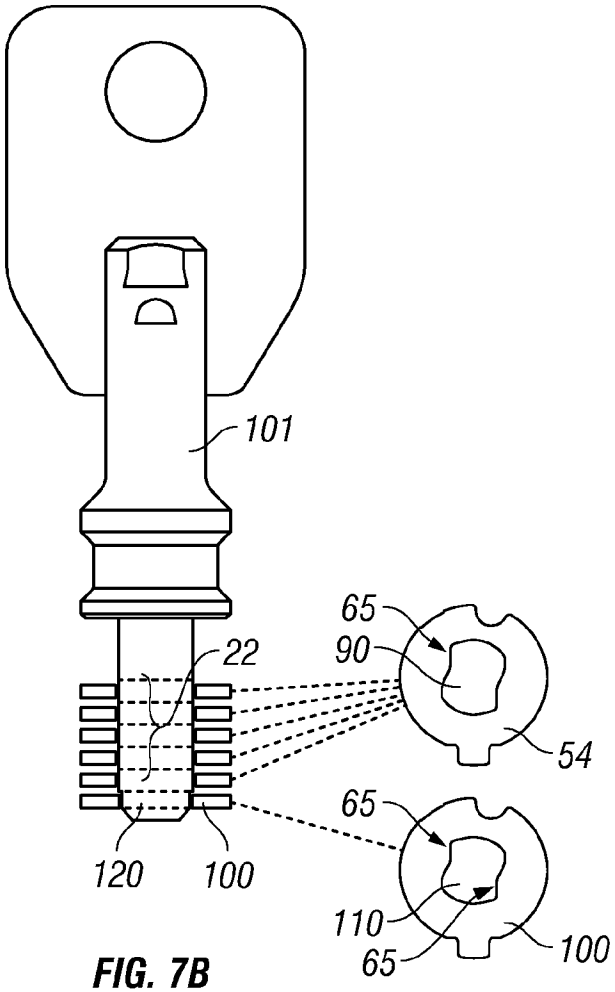
FIGS. 7A and 7B are enlarged, side views of the key and stack of disks of FIG. 5 and a key and disk stack in accordance with an embodiment of the inventive rotating disk lock mechanism, respectively.
Figure 7A:
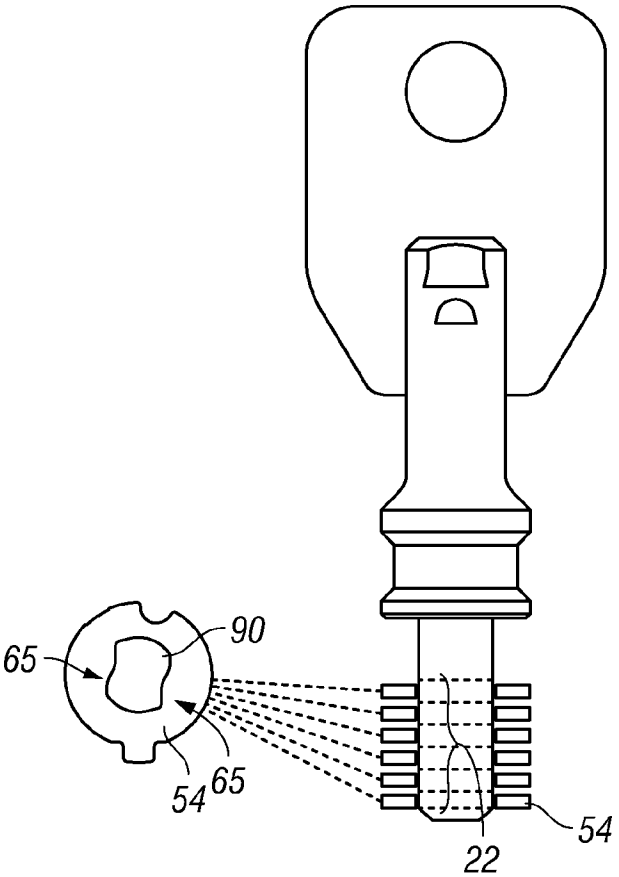
Figure 8B:
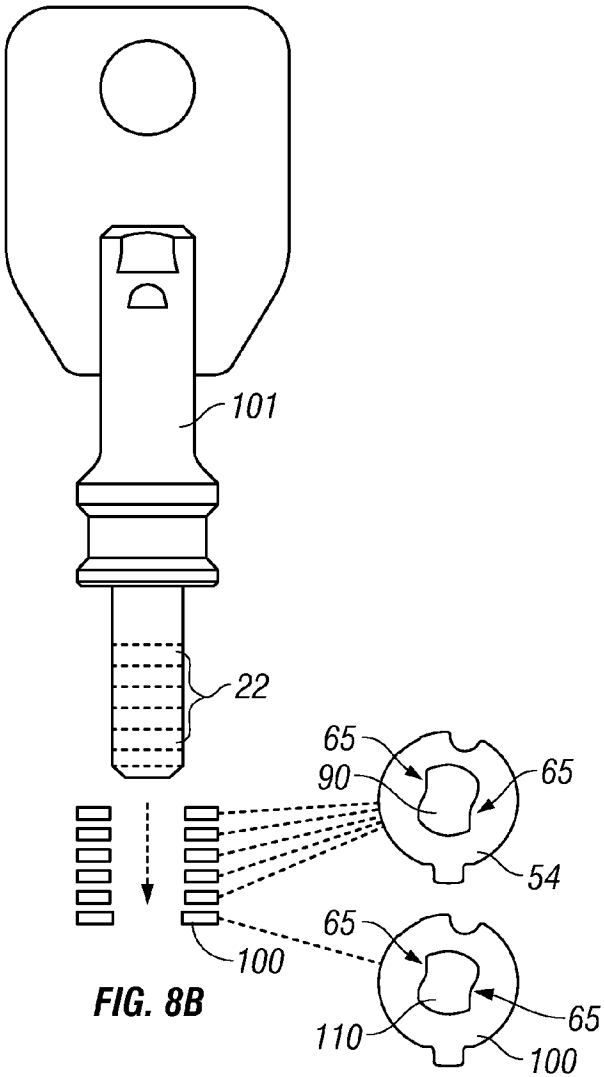
FIGS. 8A and 8B are additional enlarged, side views of the key and stack of disks of FIG. 5 and the key and disk stack of FIG. 7B.
Figure 8A:
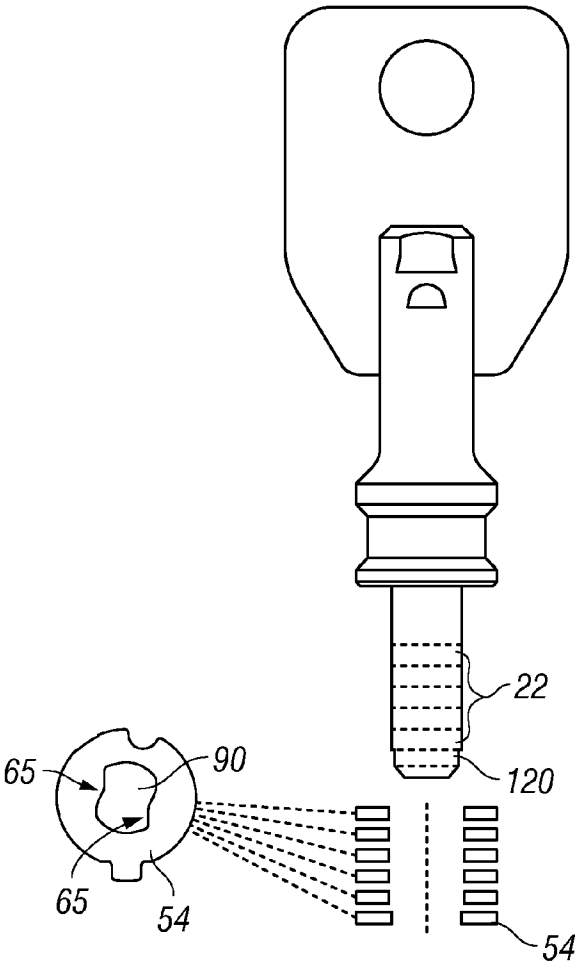
Figure 9B:
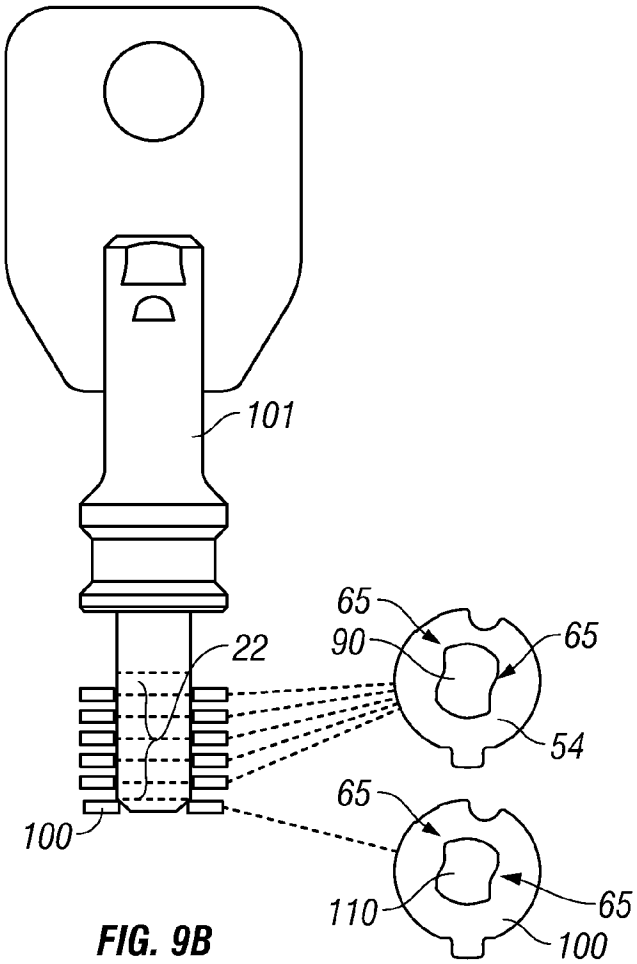
FIG. 9B is an enlarged, side view of the key of FIG. 7A in association with the disk stack of FIG. 7B.
Figure 9A:
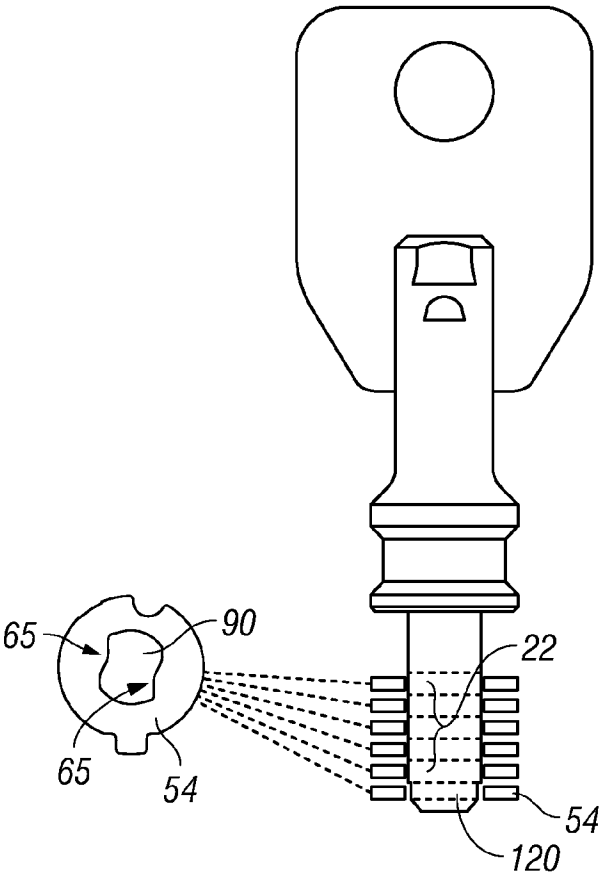
FIG. 9A is an enlarged, side view of the key of FIG. 7B in operative association with the disk stack of FIG. 7A.

FIG. 7A shows a disk 54, which has a standard size central aperture 90. In particular, a disk 54 having a known aperture diameter of 0.191 is depicted. Here, the "diameter" refers to the length of the longest internal measurement of the aperture 90. As depicted, the shape of the aperture 90 is a partially circular and the "diameter" is measured from one point on a circumferential/circular portion of the aperture to an opposite point. As shown, key cam sections 22 (which contain the key cuts) are sized to pass through this size aperture such that all of the key cuts on each cam section 22 engage spiral cam surfaces 65 on opposite sides of the each aperture 90 in the stack of combination disks sufficient to rotate the disks and unlock the lock.

Turning now to FIG. 7B, a disk 100 having a reduced diameter aperture 110 is shown. In particular, in the depicted embodiment, the diameter is reduced from 0.191 to 0.174. Apart from the reduced diameter, the geometry of the aperture 110 and its cam surfaces 65 are substantially identical to the larger diameter aperture 90.

The key 101 has a key cam section 120 that has a correspondingly reduced diameter such that it may pass through and engage cam surfaces 65 of the reduced aperture 110 to facilitate rotation of the disk 100. As will be appreciated, a "correspondingly reduced" key cam section 120 will have a size that is, in fact, slightly smaller than the diameter of the reduced aperture such that it may pass through.

Figure 10:
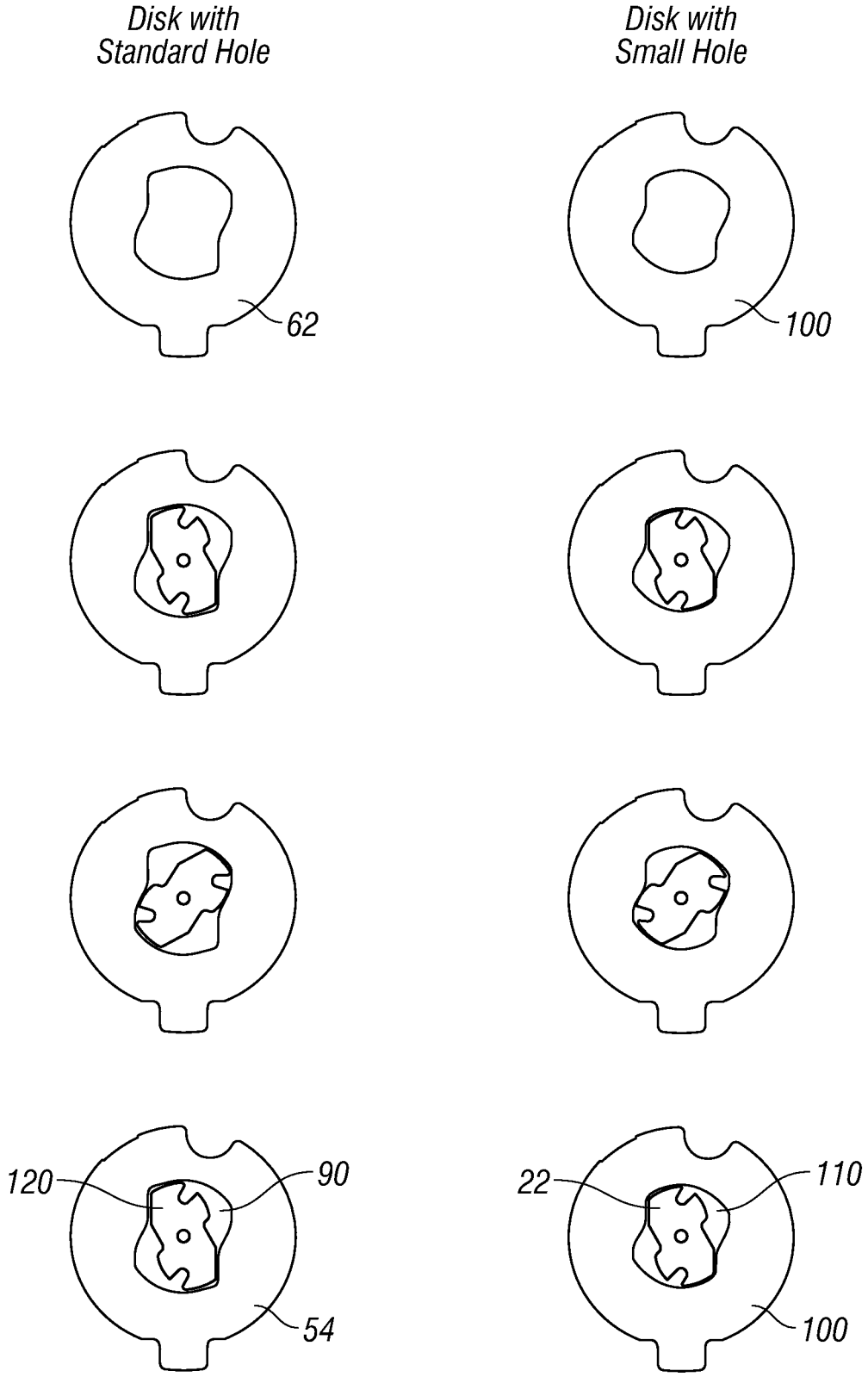
FIG. 10 is a series of front views of a normal aperture disk of the stack in FIG. 7A and a reduced aperture disk of FIG. 7B, interacting with reduced and normal sized key cam surface sections, respectively.

Referring to FIGS. 8A, 8B, 9A and 9B, a reduced diameter key cam section 120 can pass through a full size aperture 90 in disk 54. A full size key cam section 22 may not, however, pass through the reduced aperture 110 in disk 100 (FIG. 10). As will be appreciated, reduced diameter aperture disks must be placed beginning with the first disk in the stack, i.e., the disk in the first position A (FIG. 2), to facilitate insertion of the key into the keyway formed by the apertures.

Another important aspect of the invention is that the reduced size key cam section 120 is large enough to engage and rotate a disk 54 having a full size aperture 90 (FIG. 10). A full size key cam section 22 cannot, however, pass through a reduced aperture 110 as it is simply too large. This allows such keys to be used with existing locks, e.g., Levels 1-3, that include only full size aperture disks.

Figure 11:
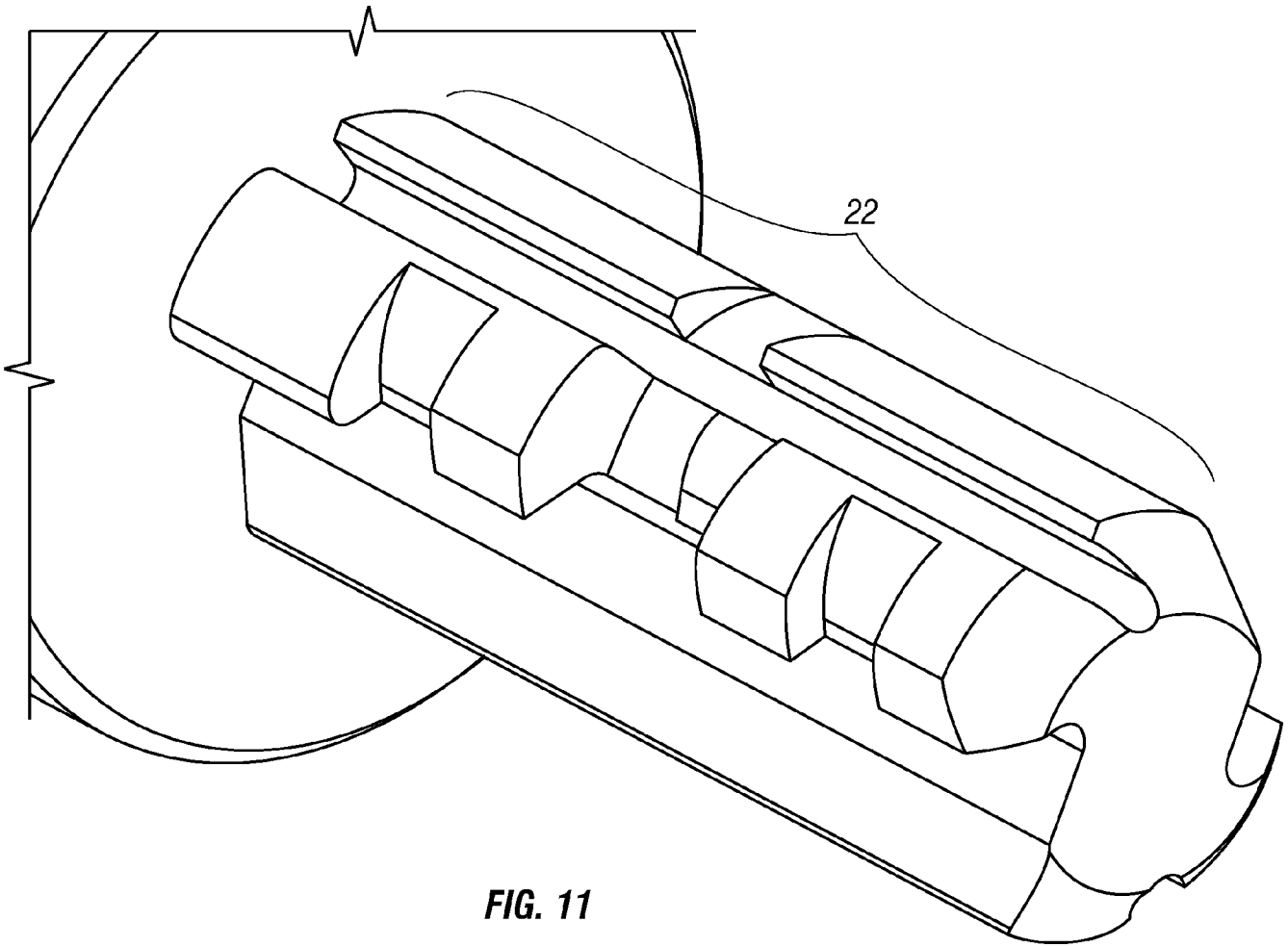
FIG. 11 is an enlarged perspective view of the key of FIG. 7A depicting cam surface sections.
Figure 12:
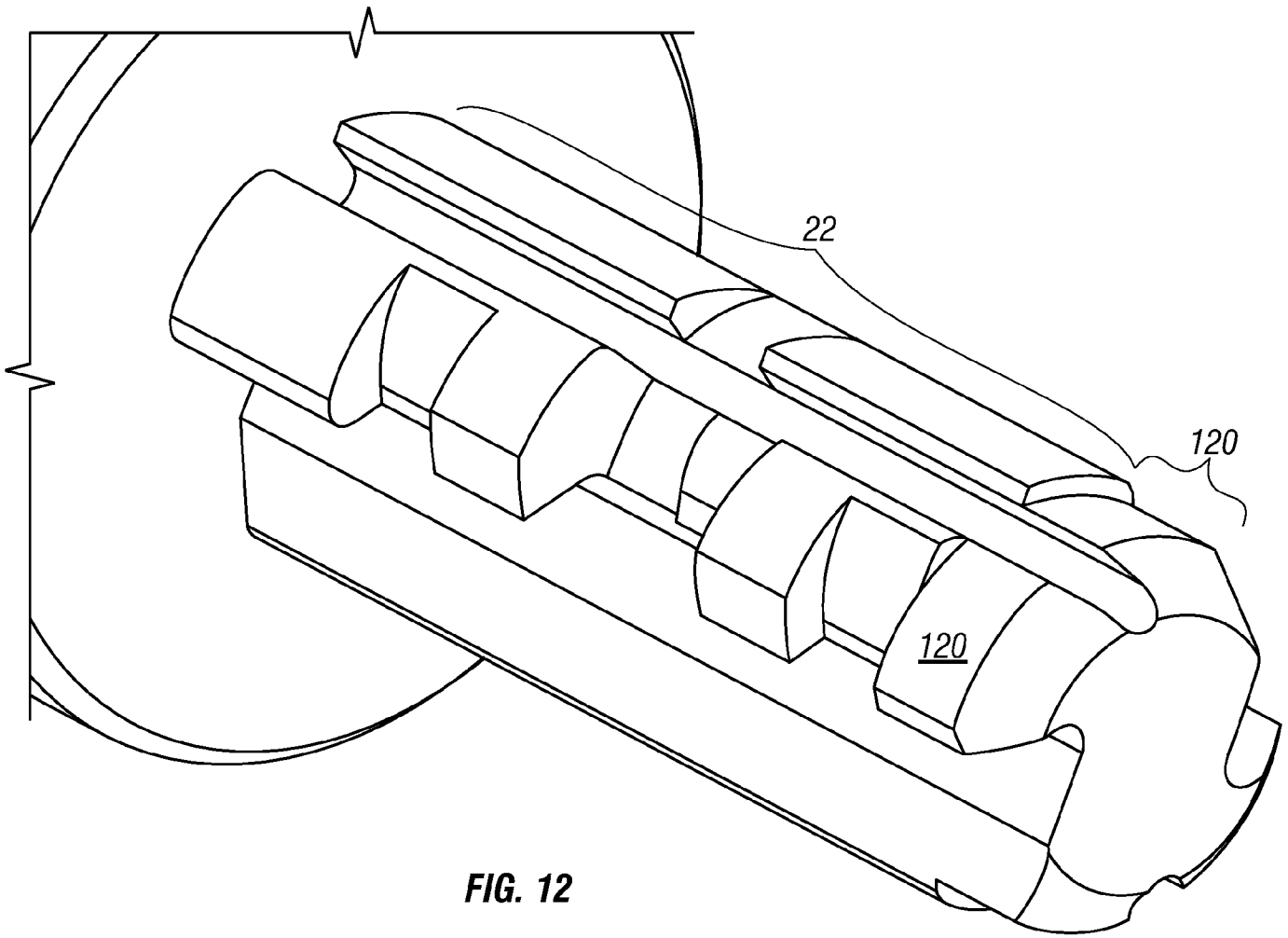
FIGS. 12-16 are enlarged perspective views of keys in accordance with an embodiment of the inventive rotating disk lock mechanism illustrating reduced size cam surface sections.
Figure 13:
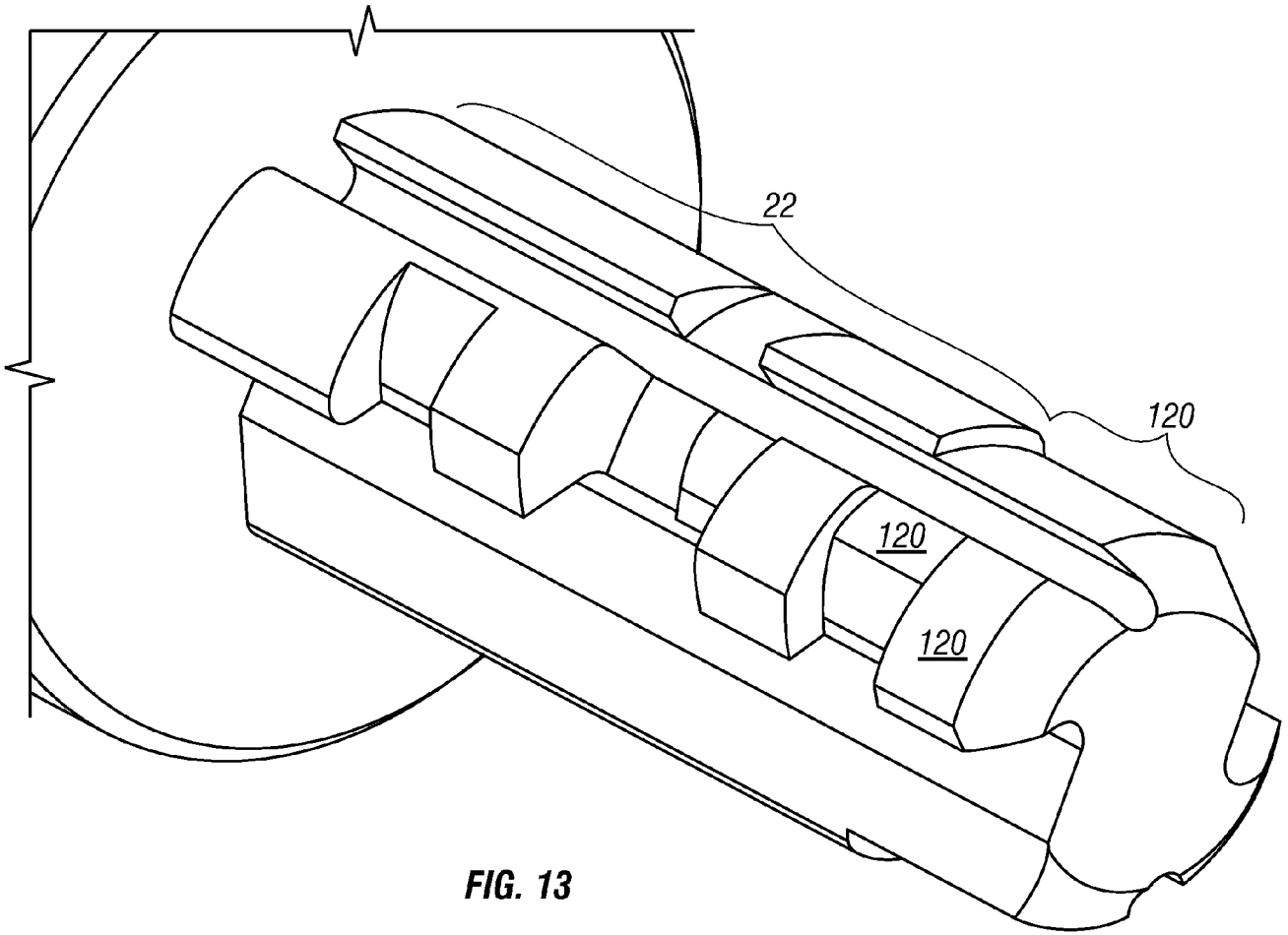
Figure 14:
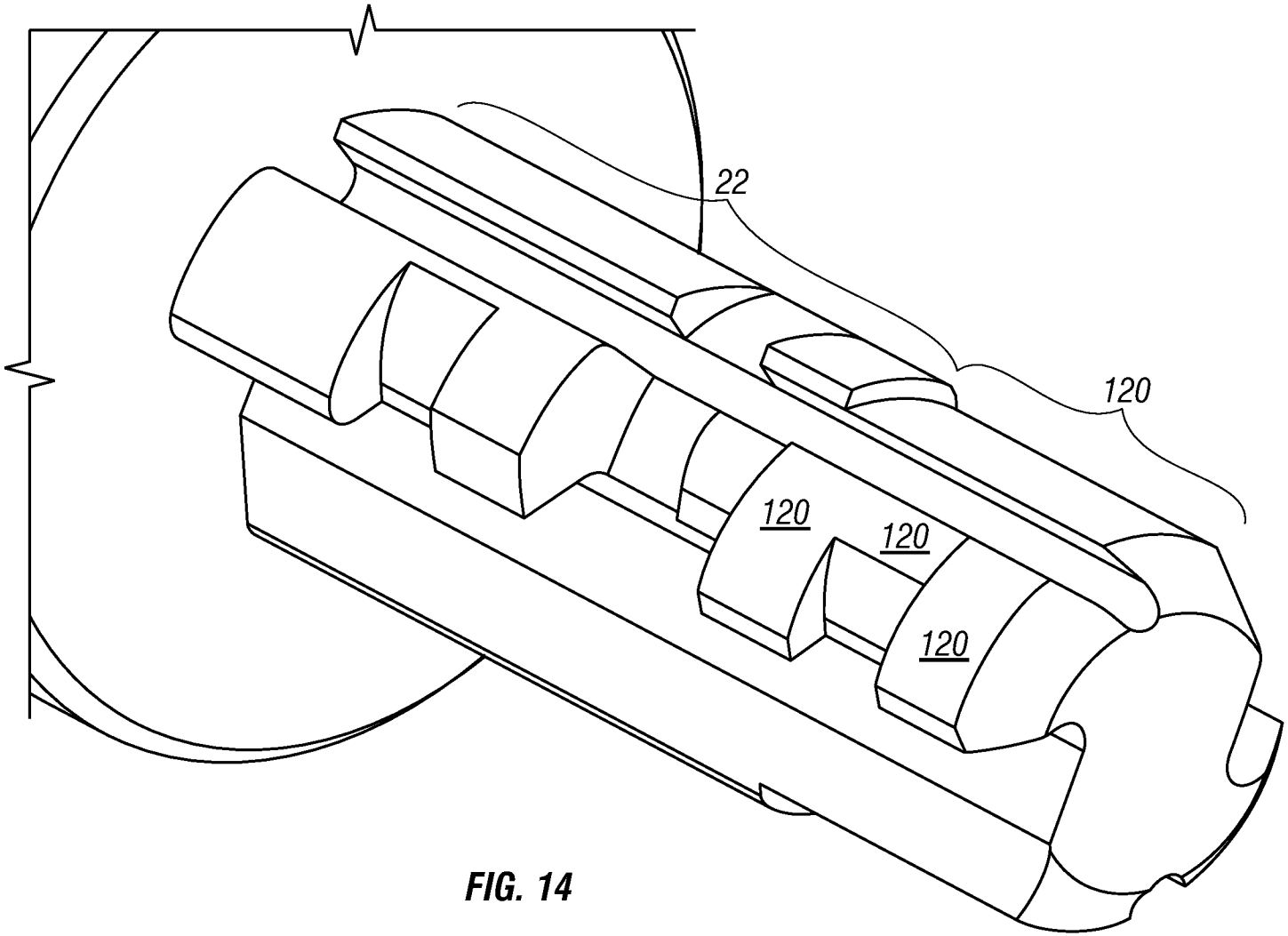
Figure 15:
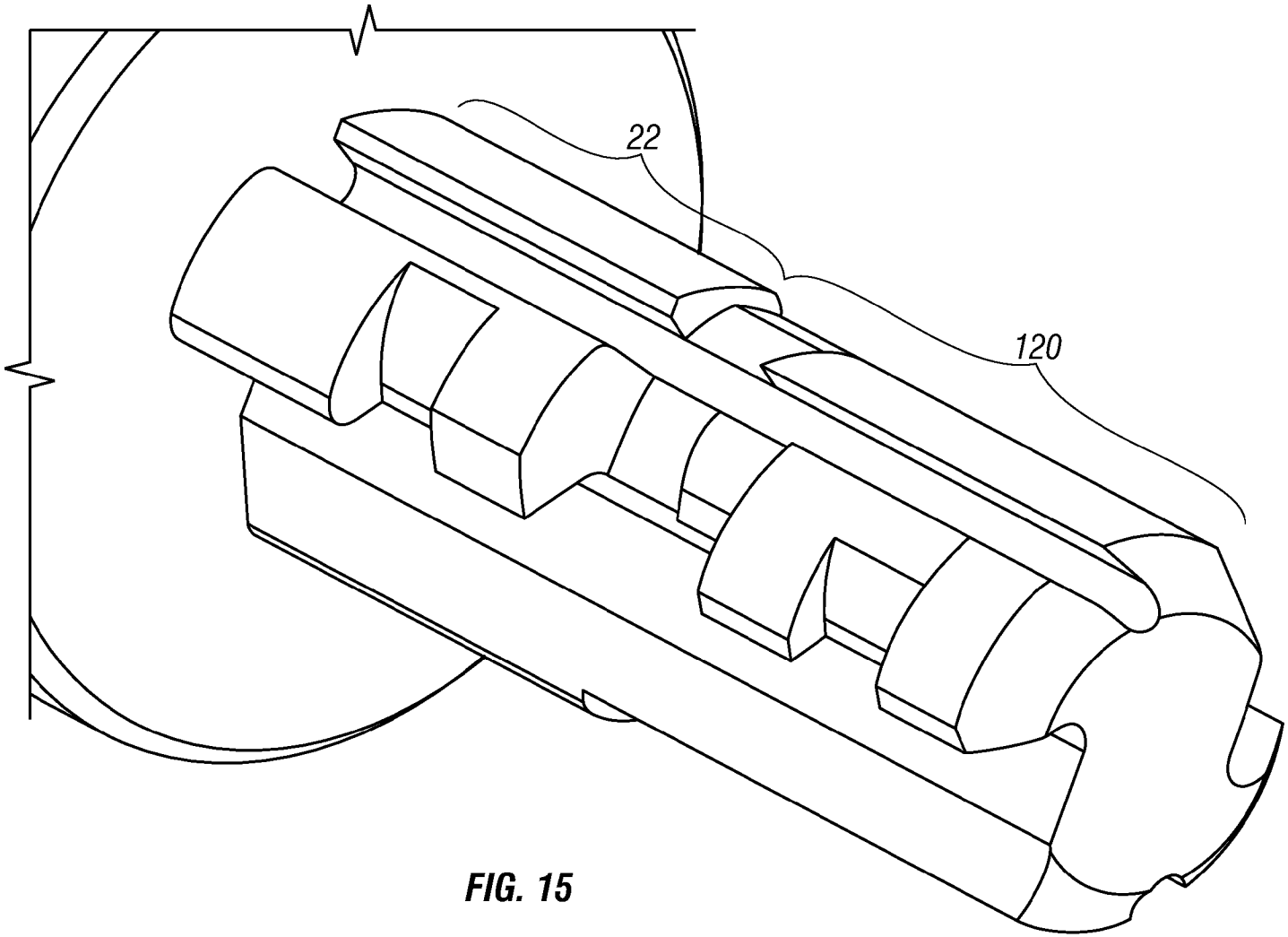
Figure 16:
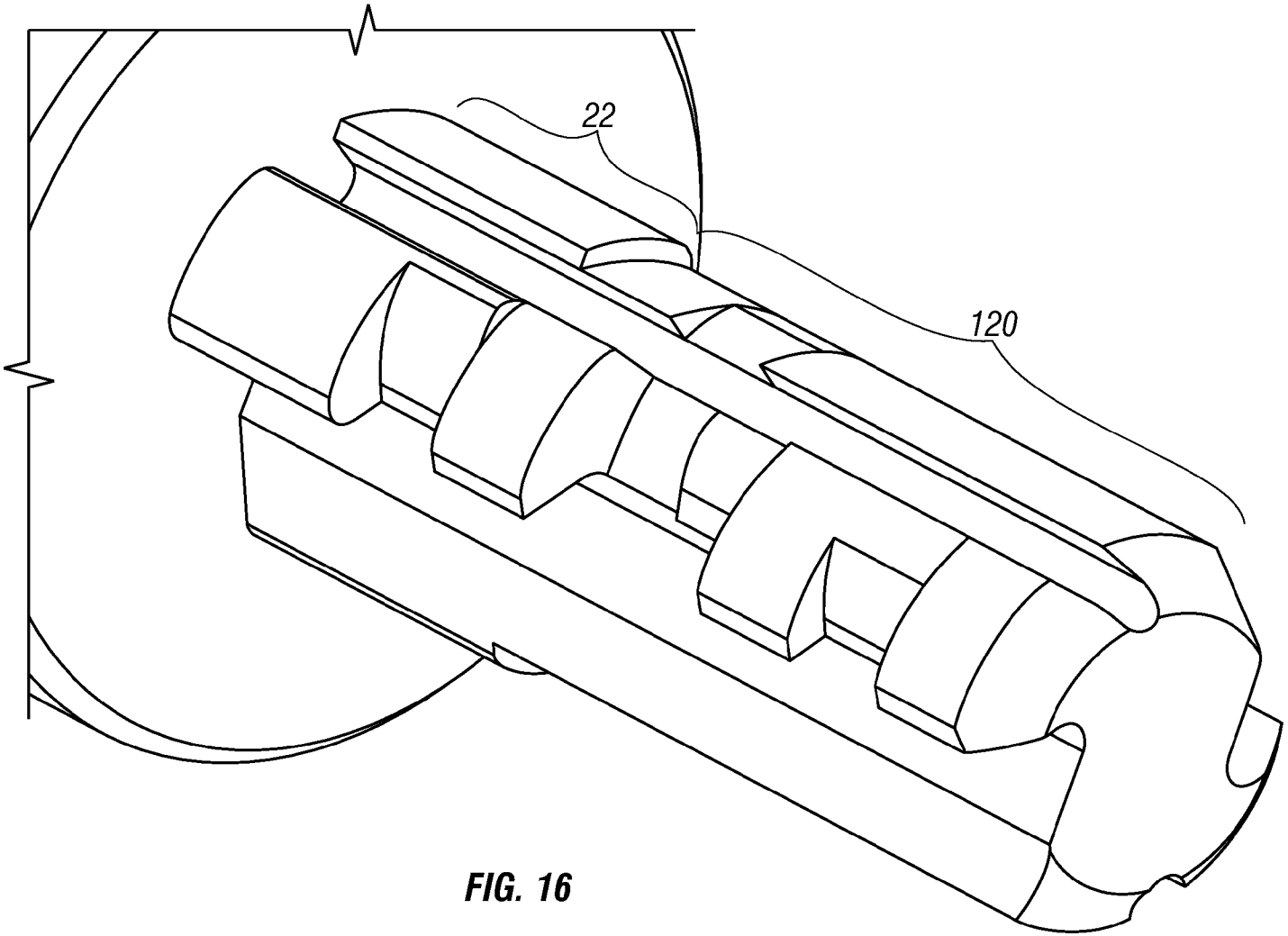

Turning now to FIGS. 11-16, keys are depicted having full and reduced diameter key cam sections. FIG. 11 depicts a conventional key with the entire key cam section 22 having a full size that corresponds to the 0.191 diameter disk aperture. FIG. 12 shows a key with a distal end cam section 120 having a reduced size that corresponds to the 0.174 diameter disk aperture. This section 120 would correspond to a reduced aperture disk in the first disk position A (FIG. 2). FIG. 13 depicts a key in which two adjacent cam sections have a reduced diameter 120. FIG. 14 shows a key with three adjacent cam sections having a reduced diameter 120. FIGS. 15 and 16 shown five and six adjacent reduced diameter sections, respectively.

Figure 17:
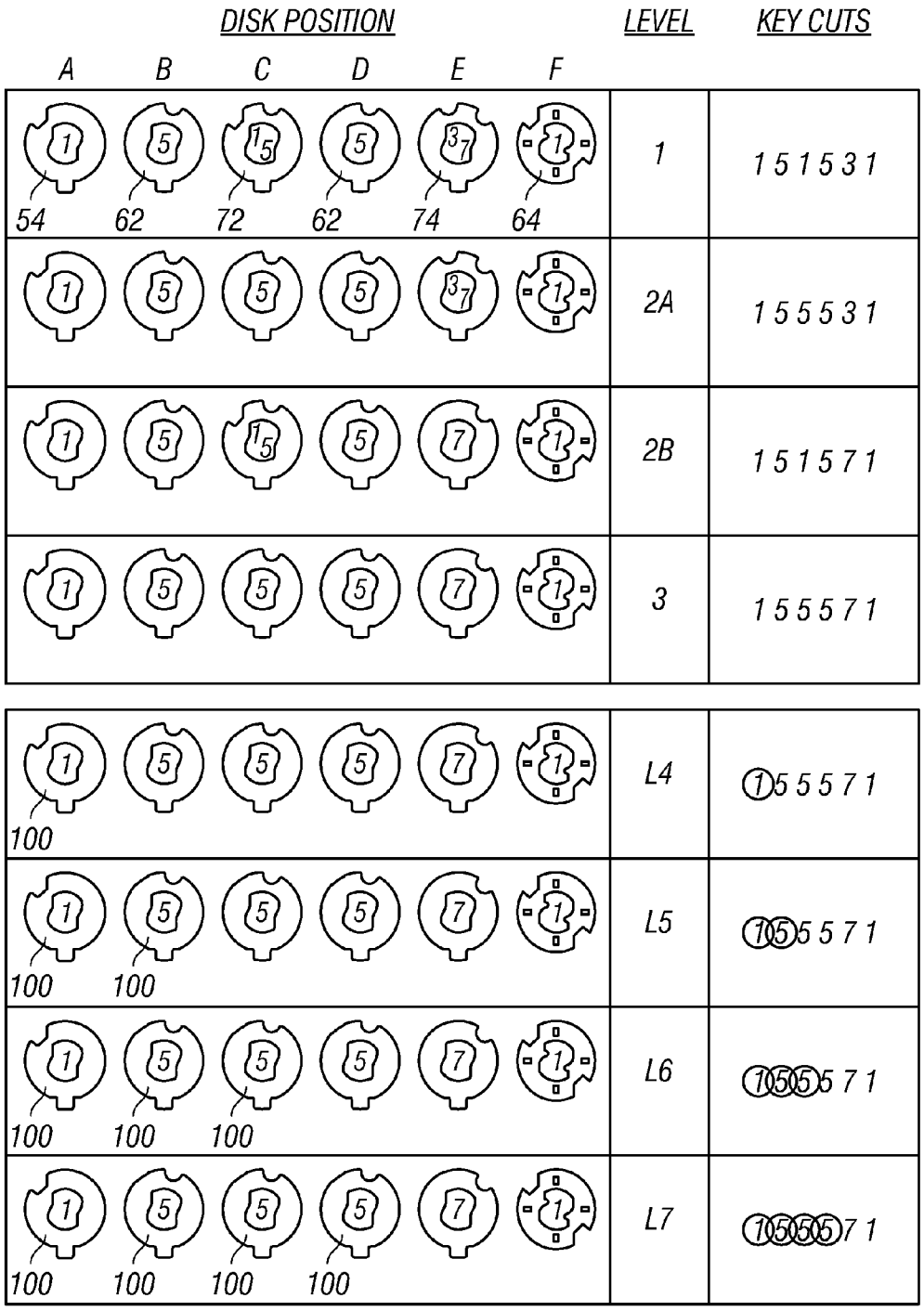
FIG. 17 is a diagram depicting the configuration of disks and corresponding key cuts for combination Levels 1-3 of the barrel lock of FIG. 1 as well as new combination Levels 4-7 facilitated through the use of the inventive rotating disk lock mechanism.

Referring now to FIG. 17, the use of disks having a reduced diameter aperture can create a large number of new "combination levels." As shown, a stack of disks can include a single reduced aperture disk 100 or multiple reduced aperture disks 100. As will be appreciated, any combination disk can be manufactured with a reduced aperture such as, for example, disks having a combination notch in the 1, 5 or 7 positions. It may also be possible to manufacture and utilize a master disk, i.e., a disk with more than one combination notch, with a reduced aperture.

In particular, a Level 4 disk and key system utilizes a single reduced aperture disk 100 in the first disk position. The key in the Level 4 system is the Level 3 key with a reduced diameter cam section corresponding to the disk 100 in the first position. As such, a Level 4 key can open a Level 4 lock as well as locks having Levels 1-3.

Figure 18:
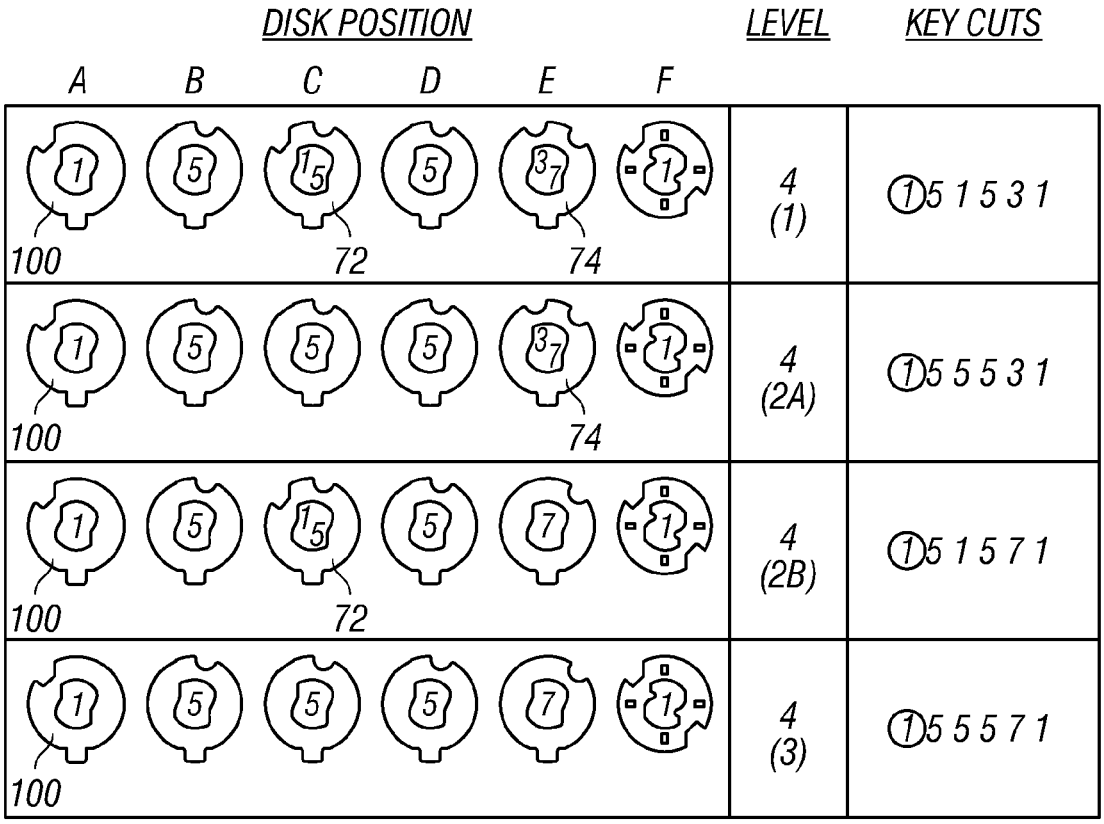
FIG. 18 is a diagram of new sub-Levels 4(1)-4(3) facilitated through the use of the inventive rotating disk lock mechanism.

As shown in FIG. 18, the use of reduced aperture disks creates combination subsets or sub-levels. For example, a Level 4 combination, having a single reduced aperture disk 100 in the sixth position, can also utilize master disks 72, 74 to create sub-Levels 4(1), Level 4(2A), Level 4(2B) and Level 4(3). The availability of sub-levels allows the inventive system to offer a greater number of combinations and an exclusivity not available with known rotating disk locking systems.

Figure 19:
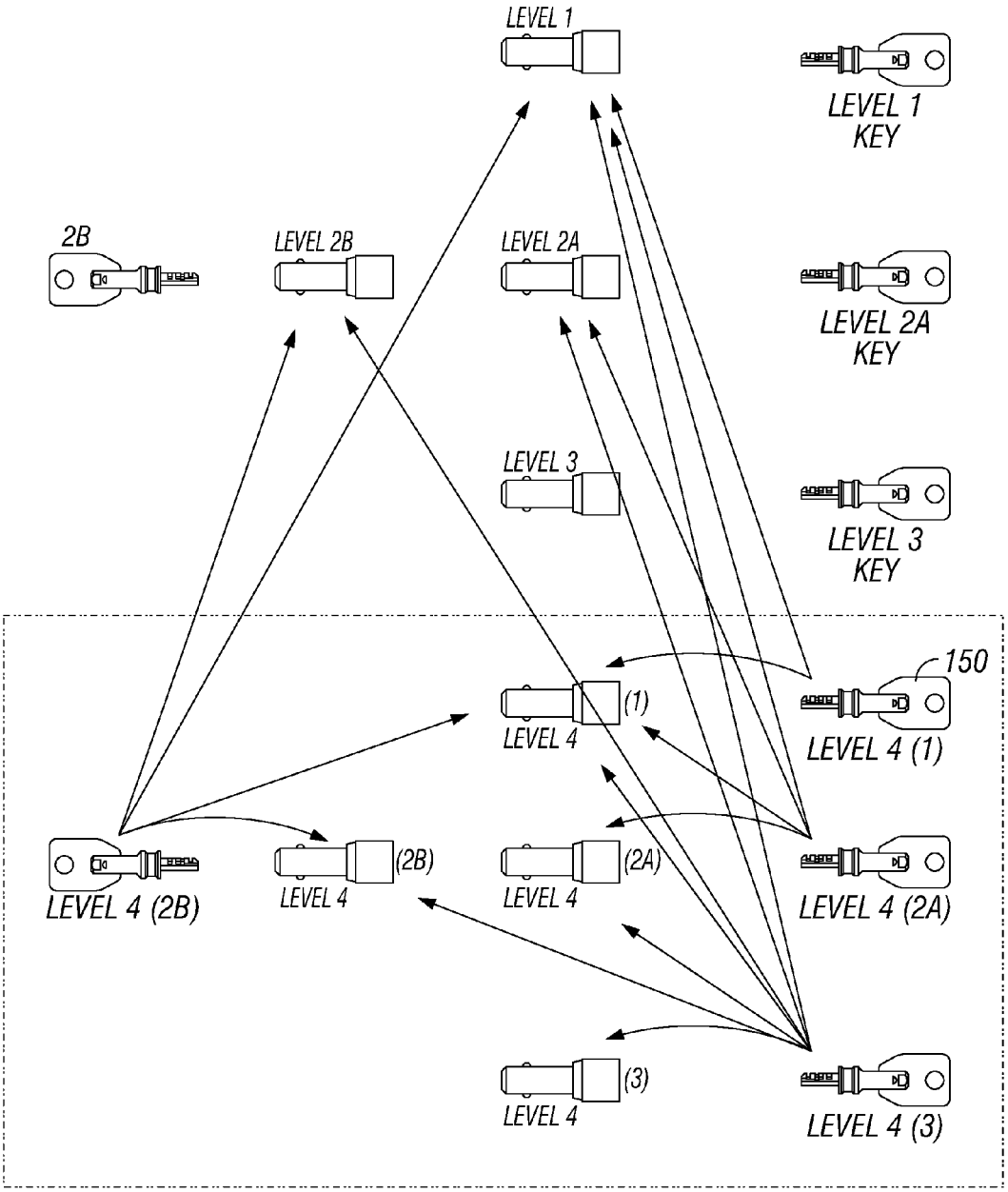
FIG. 19 is a chart graphically illustrating the inter-operability of keys of the sub-Levels 4(1)-4(3) of FIG. 18.

Referring to FIG. 19, the Level 4 sub-levels are depicted as well as the ability of Level 4 keys to operate lower Level locks. For example, Level 4(1) key 150 can open Level 4(1) and Level 1 locks. The same key cannot, however, open higher Level locks, e.g., Level 4(2A), 4(2B) or 4(3) locks.

The present invention also contemplates a method of creating lock combinations in a rotating disk barrel lock that includes a plurality of rotatable combination disks, each of the disks having a central aperture with cam surfaces. The method includes selecting a plurality of rotatable combination disks, each of the combination disks including a central aperture having a first diameter and then selecting at least one rotatable combination disk including a central aperture having a second diameter that it substantially less than the first diameter. The selected disks are then placed in a stack with a housing of the rotating disk barrel lock to create the lock combination.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

I claim:

1. A rotating disk lock mechanism having a combination, said mechanism comprising:

a lock housing; and a plurality of rotatable disks within said lock housing, each of said rotatable disks having a central aperture and a pair of opposed disk cam surfaces projecting into said central aperture, a peripheral shape of said central aperture and said disk cam surfaces defining a geometry of said central aperture, said rotatable disks being positioned in a stack such that said apertures form a keyway, at least one of said rotatable disks having a reduced central aperture with a diameter that is substantially less than a diameter of at least another one of said central apertures, said diameter being defined as a longest internal measurement of said aperture;

wherein the geometry of the central aperture of the at least one rotatable disk having the reduced diameter central aperture is substantially identical to the geometry of at least another of the rotatable disks; and wherein said combination of said lock mechanism is determined in part by the number of said rotatable disks with reduced central apertures and their placement in said stack.

2. The rotating disk lock mechanism of claim 1 wherein said plurality of disks are six disks positioned in said stack.

3. The rotating disk lock mechanism of claim 1 wherein said keyway formed by said stack has a first end into which a key is initially inserted and a second end opposite said first end.

4. The rotating disk lock mechanism of claim 3 wherein said disk having a reduced central aperture is located at said second end of said stack.

5. The rotating disk lock mechanism of claim 3 wherein said stack includes a plurality of disks having reduced central apertures, said reduced central aperture disks being adjacent to one another in said stack and one of said reduced central aperture disks being located at said second end of said stack.

6. The rotating disk lock mechanism of claim 1 wherein said reduced central aperture has a diameter of about 0.174".

7. The rotating disk lock mechanism of claim 1 further comprising:

a key having a plurality of key cam sections that engage said disk cam surfaces on said central apertures of said disks to rotate said plurality of rotatable disks to lock or unlock said lock mechanism; and wherein at least one of said key cam sections has a reduced profile that engages said reduced diameter central aperture of said reduced aperture rotatable disk.

8. The rotating disk lock mechanism of claim 7 wherein said key cam sections are located on a shaft, said shaft having a first shaft end and a second shaft end, said first shaft end being the end initially inserted in said keyway.

9. The rotating disk lock mechanism of claim 8 wherein said key cam section with said reduced profile is at said first shaft end.

10. The rotating disk lock mechanism of claim 8 wherein said key includes a plurality of key cam sections having a reduced profile, said reduced profile key cam sections being adjacent to one another on said shaft and one of said reduced profile key cam sections being located at said first shaft end.

11. A lock system comprising:

a rotating disk lock mechanism having a housing that includes a plurality of rotatable disks positioned in a stack within said housing, each of said rotatable disks having a central aperture that, when positioned in said stack, form a keyway, each of said rotatable disks also having a pair of opposed disk cam surfaces extending into said central aperture, at least one of said central apertures having a reduced diameter that is substantially less than a diameter of at least another one of said central apertures;

a key having a plurality of key cam sections that engage and rotate said plurality of rotatable disks to lock or unlock said lock mechanism;

wherein at least one of said key cam sections has a reduced profile that engages at least one of said opposed cam surfaces of said reduced diameter central aperture and rotates said rotatable disk having said reduced diameter central aperture;

wherein said diameter is a longest internal measurement of said central aperture; and wherein a geometry of the central aperture of the rotatable disk having a reduced diameter, defined by a peripheral shape of the central aperture and the shape of the cam surfaces, is substantially identical to the geometry of the central aperture of at least another of the rotatable disks.

12. The lock system of claim 11 wherein said key cam sections are located on a shaft, said shaft having a first shaft end and a second shaft end, said first shaft end being the end initially inserted in said keyway.

13. The lock system of claim 12 wherein said key cam section with said reduced profile is at said first shaft end.

14. The lock system of claim 12 wherein said key includes a plurality of key cam sections having a reduced profile, said reduced profile key cam sections being adjacent to one another on said shaft and one of said reduced profile key cam sections being located at said first shaft end.

15. The lock system of claim 11 wherein said plurality of disks are six disks positioned in said stack.

16. The lock system of claim 11 wherein said keyway formed by said stack has a first end into which said key is initially inserted and a second end opposite said first end.

17. The lock system of claim 16 wherein said disk having a reduced central aperture is located at said second end of said stack.

18. The lock system of claim 16 wherein said stack includes a plurality of disks having reduced central apertures, said reduced central aperture disks being adjacent to one another in said stack and one of said reduced central aperture disks being located at said second end of said stack.

19. A method of creating lock combinations in a rotating disk barrel lock that includes a plurality of rotatable combination disks, each of said disks having a central aperture with a pair of opposed cam surfaces, said method comprising the steps of:

selecting a plurality of rotatable combination disks, each of said combination disks including a central aperture having a first diameter; and selecting at least one rotatable combination disk including a central aperture having a second diameter that it substantially less than said first diameter;

wherein said first diameter and said second diameter are defined as a longest internal measurement of said central apertures; and wherein a geometry of the central aperture of the rotatable combination disk having the central aperture with the second diameter, defined by a peripheral shape of the central aperture and the shape of the cam surfaces, is substantially identical to the geometry of the central aperture of at least one of the rotatable disks with the first diameter.

20. The method of claim 19 further comprising:

placing said selected rotatable aperture disks in a stack within a lock housing.

* * * * *